United States Patent [19]

Simmons

[11] 4,239,005

[45] Dec. 16, 1980

[54] DEVICE FOR AN ELECTRIC IGNITER

[75] Inventor: Björn Simmons, Karlskoga, Sweden

[73] Assignee: Aktiebolaget Bofors, Bofors, Sweden

[21] Appl. No.: 895,406

[22] Filed: Apr. 11, 1978

[30] Foreign Application Priority Data

Apr. 19, 1977 [SE] Sweden ..... 7704436

[51] Int. Cl.[3] ..... F42C 11/00

[52] U.S. Cl. ..... 102/28 R; 102/46; 102/203; 102/265

[58] Field of Search ..... 102/28 R, 28 M, 46, 102/202, 203, 265; 89/1 C

[56] References Cited

U.S. PATENT DOCUMENTS

| | | | |
|---|---|---|---|
| 2,141,827 | 12/1938 | Schlumberger | 89/1 C |
| 3,407,732 | 10/1968 | Przybylik et al. | 102/28 R |
| 3,759,183 | 12/1971 | Apstein | 102/28 R |

*Primary Examiner*—Harold J. Tudor

*Attorney, Agent, or Firm*—Pollock, Vande Sande & Priddy

[57] ABSTRACT

An electric ignition device having a pyrotechnical delay portion and a pyrotechnical ignition portion enclosed in a container. A first conducting ignition element is supported adjacent the delay portion and a second conducting ignition element is supported adjacent the ignition portion. The elements are connected in series to receive a voltage input from an external source. The first element is dimensioned so that it will heat to an ignition temperature in response to a particular low voltage level and will conduct when a higher second voltage level is applied. The second element will heat to an ignition temperature only when the second voltage level is applied. If the first voltage level is applied, the first element heats and ignites the delay portion and the delay portion burns at a particular rate for a characteristic delay interval and then ignites the ignition portion. If the second voltage is applied, the second element heats to rapidly ignite the ignition portion.

3 Claims, 8 Drawing Figures

A—A

B—B

DEVICE FOR AN ELECTRIC IGNITER

The present invention relates to a device for an electric igniter which comprises a pyrotechnical initiating composition, a delay composition and electric circuits having filaments or corresponding ignition elements which heat to ignition temperatures when power is connected to the electric circuits.

In principle, the apparatus of the invention is a further improvement of the so-called bridge-wire igniter. The improved igniter overcomes problems that occur when an electric ignition cap (blasting cap) functions as a modular unit. The improved igniter has universal applicability for achieving longer or shorter ignition times for rocket motor ignition systems or for bursting charges in shells or the like.

In accordance with the invention, a new electric ignition cap is provided wherein at least one pyrotechnical delay composition is utilized with corresponding ignition elements to ignite an initiating composition at least two different ignition times. The ignition times may be determined by selecting a particular burning time for the delay composition and by selecting the elements to ignite either the delay composition or the initiating composition.

In embodiments of the invention it will be possible to construct the electric ignition or blasting cap so that the delay times can be chosen within an extremely short time interval, from nanoseconds or microseconds up to several seconds.

In addition to having a very safe and reliable operation, the new electric cap will also have a comparatively simple construction, and extremely small external dimensions as well. The small dimensions makes it possible, if desired, to substitute a common cap working with only one delaying time with the new cap working with at least two delaying times without requiring a redesign of a whole ignition system. The new cap can also be made very sensitive, thereby allowing simpler power sources to be used.

The electric cap, according to the invention, has mutually separated ignition elements and at least one pyrotechnical delay composition for igniting an initiating composition at two different initiation or delay times. The different delay times may be selected by means of different pulse features, for example either high or low power levels applied to the elements or different connection paths for the power.

Figure 2:
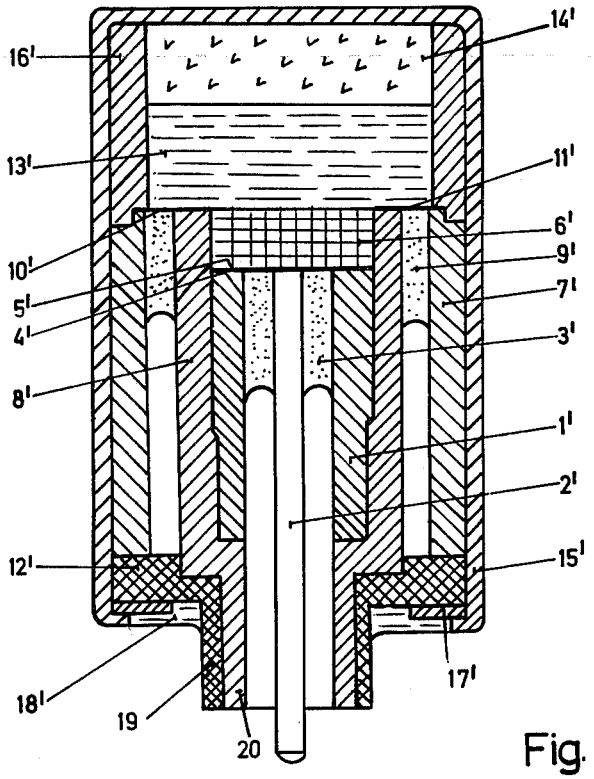
Figure 3:
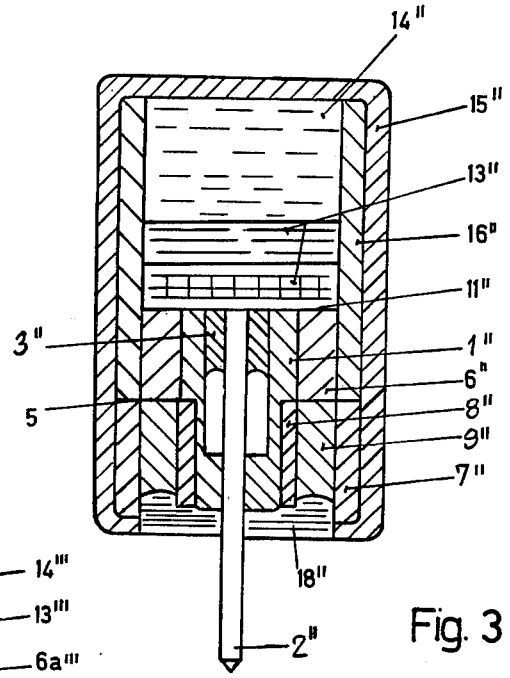
Figure 4:
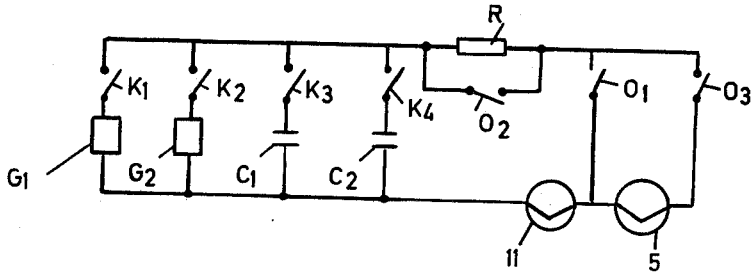

Proposed embodiments of the electric igniter according to the invention will be described in the following, with reference to the accompanying drawings, in which FIG. 1 in a vertical section shows the electric ignition cap in a first embodiment made for single-pole connection, FIG. 2 in a vertical section shows the electric ignition cap in a second embodiment made for double-pole connection, FIG. 3 in a vertical section shows the electric ignition cap in a third embodiment, FIG. *3a* in a vertical section shows the principle of the modifications of the parts in the embodiment according to FIG. 3, FIG. 4 schematically shows the electric circuits, and FIGS. *5a*—*5c* in a vertical section and cross-sections show the electric ignition cap in a third embodiment made for single-pole connection.

In the figures, parts corresponding to each other have been given the same reference designations, supplemented with prime signs, double prime signs, tripe prime signs, etc.

Figure 1:
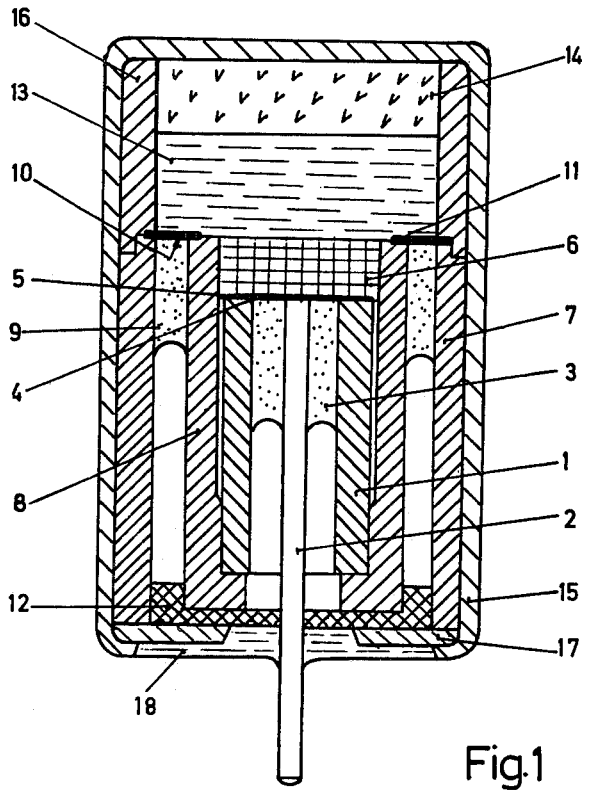

In FIG. 1, a first unit made of electrically conducting material, for instance chromium steel or similar material, is indicated by the numeral 1. The first unit is made in the form of a sleeve, and coaxially inside the unit is rodshaped second unit 2 is arranged, which is also made of an electrically conducting material such as an iron or nickel alloy or the like. The units are fixed in relation to each other by means of an electrically insulating body 3 made substantially of glass or porcelain. The units 1 and 2 and the body have a common end surface 4, at which is arranged at least one first element 5 in the form of a bridging element, electrically connecting the units 1 and 2. In the present embodiment the connection is achieved by means of a metal layer which has been applied directly on the surface by means of vacuum evaporization, a technique which is known in itself. The metal layer may consist of a very thin (e.g. $2.10^{-8}$ m) layer of chromium adajacent the surface and, on top of the chromium layer, a very thin (e.g. $10^{-7}$ m) layer of gold. The layer of chromium guarantees very good adhesion to the units and the body, while the gold layer or the like guarantees good electrically conducting properties and corrosion resistance. Before the layers are applied, the surface should be ground and polished very carefully, and the connection between the units 1 and 2 and the insulating body 3 should also be made with great mechanical strength and tightness (helium-tight) to ensure that there will be no interruption in the thin layers of metal. Great mechanical strength is obtained when the glass body is melted in between the metal units, which are chosen so that a good wetting effect will be obtained. In certain cases, the good wetting effect can be obtained by providing appropriate thicknesses for the oxide layers which are formed. Further, the material in the units 1 and 2 and the body 3 have substantially the same coefficients of expansion, so that the electric ignition or blasting cap will function within the temperature range in which ammunition of the type contemplated is used. The metal layer is cut up with a laser or the like, to form distinct bar-shaped elements with dimensions that can easily be determined. Since the dimensions of the bars can be determined, and since there are no welds or soldered connections for the elements, the elements may be made with different degrees of sensitivity, that is their ignition temperatures may be predetermined in a simple manner for different values of connected capacitance or applied voltage. However, the invention may also function with conventional filaments that may be employed to replace the described elements. Corresponding connections may also be obtained by utilizing baked-in graphite powder or the like in the initiating composition and delay composition, to form conducting composition igniters.

A first pyrotechnical delay composition 6 is pressed with a comparatively high pressure, for example 20–100 MPa against the surface 4 and the metal layers and cut-out bar elements. The delay composition 6 may be ignited by means of a first element 5 when a capacitance voltage or other voltage of a certain size is applied to the element to cause the element to heat to the ignition temperature. The size of the applied capacitance voltage or other voltage is identified hereafter as the first power level. The delay composition 6 is of a known kind which burns gaslessly and which comprises oxidation and reducing agents in proportions which permit combustion.

A third unit 7, made of electrically conducting material such as chromium steel or the like, and a fourth unit 8, of for example iron-nickel, are connected in the manner described for the first and second units. Thus, both the third unit and the fourth unit are shaped in the form of a sleeve. The fourth unit 8 encases the first unit 1, to which it is also galvanically connected at one end. The third and the fourth units are separated from each other by means of a second electrically insulating body 9 made of glass or porcelain in the manner described the first insulating body 3. The units 7 and 8 and the insulating body 9 have a second surface 10 which corresponds to the first surface 4. The surface 10 carries metal layers which correspond to those on the surface 4, and two bar-shaped elements 11 are cut out of the layers on the surface 10 by means of a laser or the like the two bars then, connecting the units 7 and 8. The number of elements 11 can, of course, be varied, for example one or more elements may be employed. Thus, the invention is not limited to two elements. The units 7 and 8 are held together at their ends via a supporting part 12 that is made of electrically insulating material. The first unit is supported in the fourth unit in both the radial and the axial directions, the fourth unit then being made with a folded-in flange, for fixation in the axial direction. At the flange, the unit 8 has an aperture running through it, through which the unit 2 extends. The fourth unit extends longer than the first unit at a top end. The delay composition is shaped as a solid cylinder or a circular disc and is located within the fourth unit, at the top end.

An initiating composition, comprising for example a first layer 13 of lead or silver azide and a second layer 14 of hexogen or penthrite, is pressed with a high pressure, for example 20–100 MPa, on the second surface 10 and elements 11. When the elements 11 reach their ignition temperatures, the initiating composition is ignited, that is the first layer 13 is ignited and the ignited layer 13 ignites the layer 14. Along its central portion, the silver or lead azide layer is in high pressure contact with the delay composition. The units 1, 2, 7 and 8 and the pyrotechnical compositions are enclosed in a capsule or container 15. Inside the container, the layers 13 and 14 of the initiating composition are enclosed by a supporting part 16, which is in contact with one end of the unit 7. At its other end, the container 15 is provided with a cover 17 which rests against the other end of the unit 7 and which is provided with an aperture through it, like the supporting part 12. The rod-shaped unit 2 extends through apertures in the unit 8, the part 12 and the cover 17. The cover and the unit 2 are sealed against moisture with an electrically insulating coating 18 of glue or the like, which keeps all of the parts inside the electric igniter well protected from moisture. The high pressure for the compositions 6 and 13, 14 is achieved in a press and is maintained by folding the container 15 over the cover, in a way which is known in itself. The container 15 has an outer diameter of 6.5 millimeters.

The electric ignition cap forms a single-pole connection, the unit 2 being connected to a voltage source and the container 15 being connected to the material (grounded) of the projectile, shell, rocket or other body that is employed in the electric ignition system.

The units 1, 2, 7 and 8 are connected in series and the elements 5 and 11 provide a number of paths for the current passing through the units. In the present case, the first element 5 is made so that it is sensitive, i.e. it assumes an ignition temperature when there is a comparatively low capacitance voltage or other voltage. The second elements 11 are assumed to be comparatively insensitive or slow, and, therefore, do not heat to their ignition temperatures until there is an applied capacitance or voltage which well exceeds the first capacitance or voltage.

When the capacitance or voltage of lesser magnitude is connected between the unit 2 and the container 15, there is an electric connection via the unit 2, the element 5, the unit 1, the unit 8, the elements 11, the unit 7 and the container 15. When a particular relatively low power is supplied, the sensitive element is heated to its ignition temperature, and the delay composition is ignited and begins to burn gaslessly in its axial direction. When the delay composition has burned to its furthest extent, the silver azide layer and the hexogen or penthrite layer are ignited, in the order mentioned. The first delay time between the connection of the electric power and the ignition of the initiating composition 13, 14, is determined substantially by the burning time of the delay composition since the heating of the element 5 to its ignition temperature is assumed to take place very rapidly, and is negligible in this connection. It should be obvious that the electric ignition cap may be constructed to provide different lengths for the delay composition, and corresponding different delay times, which can be chosen e.g. between 0.5 ms and several seconds, particularly between 0.5 and 5 ms. When the initiating charge 13, 14 is ignited, the container 15 bursts, and a detonation (or an ignition flash if a different type of initiating composition is used) is obtained which can be used to set off various kinds of main charges. In this case, the elements 11 are not heated to their ignition temperature.

The new electric ignition cap also permits a very rapid ignition of the initiating composition 13, 14. When a capacitance or voltage of greater magnitude is applied, the ignition temperature is reached very rapidly, not only by the element 5, but also by the element 11, thus the initiating composition is directly ignited by the elements 11 after a second initiating or delaying that is only a few microseconds after the capacitance or voltage has been connected. In accordance with the invention the capacitance or voltage is of such a magnitude that the first element 5 maintains its conducting capability until the elements 11 have reached an ignition temperature and ignited the composition 13, 14.

Tests have shown that a good initiating function of the pyrotechnical composition can be obtained from the respective elements, and that a capacitance of $0.1.10^{-6}$ F utilized for the first element is activated at 100 V and the second elements at 200 V. At 200 V the first element maintains its conducting capability even though evaporation of the first element may have begun.

The electric ignition cap according to FIG. 2 is built up in general in the same way as the embodiment according to FIG. 1. However, the supporting part 12' and the unit 8' of FIG. 2 have been provided with a neck-shaped part 19 and 20, respectively, arranged so that the unit 8' will be available for connection to one of the poles of the source of power utilized to ignite the cap. Thus, connection between the grounded container 15' and the unit 2' may be made as in the embodiment according to FIG. 1. Alternatively, a source of power may be connected either between the unit 2' and the unit 1', thereby energizing only the first element 5', or between the unit 1' and the container 15' thereby energizing the second element 11. In the latter case, the elements 5 and 11 are made with the same high sensitivity, so that with the indicated connection, of the delay composition and the initiating composition 13', 14' will be simultaneously ignited. Thus, the structure of FIG. 2 creates a double pole connection in which the first element(s) and the delay composition 6' create a first ignition circuit for the initiating composition, and the units 7 and 8 and the second element(s) create a second ignition circuit for the initiating composition.

The embodiment according to FIG. 3 is particularly directed to the problem of achieving an electric ignition cap with extremely small external dimensions, particularly in the axial length of the cap. In this case, the units 1'' and 2'' and the body 3'' have been arranged inside units 7'' and 8'' and the body 9''. The unit 8'' is utilizied as a connection to the single-pole electric ignition cap, which can have its outer capsule connected to the material of the shell in which the cap is used. Through this arrangement, the first delay composition 6'' is shaped in the form of a hollow cylinder that is placed outside the unit 1''. Thus, the cap of FIG. 2 has a smaller axial length than the cap of FIG. 1. Further, the units 1'' and 8'' are galvanically contacting the unit 1'' having a lower half with a smaller diameter for engaging and supporting the unit 8''. Also, the body 9'' has a comparatively shorter axial length while the supporting part 16'', is extended so that it can enclose the delay composition 6'' in addition to the pyrotechnical composition 13'', 14''. With the construction thus obtained, the element 5'' (one or several) will be located below the element 11'' (one or several) instead of the other way around, as in the embodiments previously described.

Figure 3A:
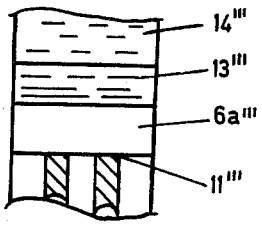

In the examples described above, it has been assumed that the second element is to ignite the initiating composition directly. It is, of course, also possible to allow the second element to ignite the initiating composition via a second delay composition, which has been shown in principle in FIG. 3*a*, in which the second delay composition has been given the designation 6*a*'''. In FIG. 3*a*, for the sake of clearness, only the second element 11''' and the initiating composition 14''' with the silver azide layer 13''' have been shown. The composition 6*a* and 6*a*''' have, in principle, the same embodiment. FIG. 4 is intended to show the electric circuit diagram for the different connection alternatives mentioned above. The capacitors $C_1$ and $C_2$ of different power and/or voltage sizes can be charged individually or together with electric generators $G_1$ and $G_2$, respectively, which are known in themselves, and which can be made to produce different voltages and power. The connection contacts for the generators and capacitors are shown by $K_1$—$K_4$ and switches for connecting the different connection circuits are shown by $O_1$—$O_3$. Through the actuation of said contacts and switches, the elements 5 and 11 can be connected to one or both capacitors, together or individually, directly or via a resistor R. Likewise, the capacitors can be charged from one generator each or together from one common generator. A projectile is usually not provided with all of these alternatives, but only one or two, for which the universal electric igniter is to function. For certain kinds of ammunition it may be advisible to provide the projectile or the like with the possibility of having alternative settings of the voltage level or connection in question. The projectile or the like is therefore provided with a manual setting means which in a first position gives a first level or circuit and in a second position gives a second level or circuit. Setting of the means can then be done for example on the occasion when loading takes place. At the setting, the switches $O_1$—$O_3$ are actuated.

Figure 5A:
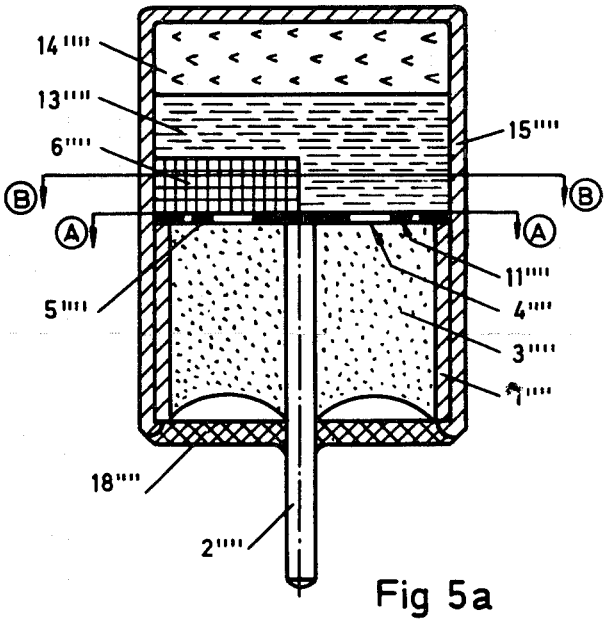
Figure 5B:
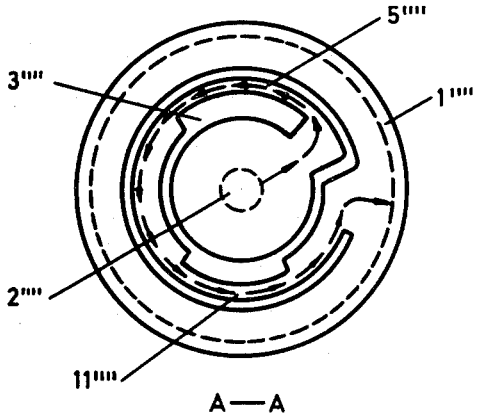
Figure 5C:
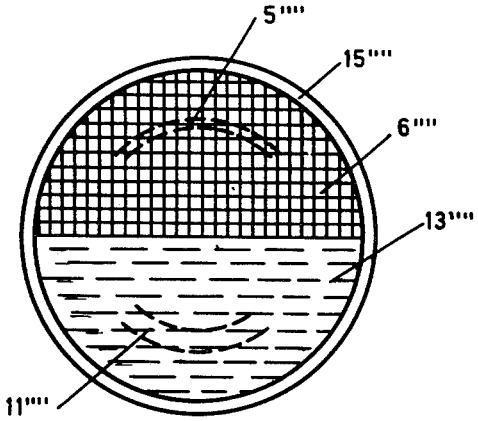

In FIG. 5*a*—5*c* there is illustrated a third embodiment of the ignition or blasting cap. In this embodiment the first and second elements 5'''' and 11'''', respectively, are located in a common plane and are attached to the same surface 4'''' in the same way as described above. As shown in FIG. 5*b* there is only one first element 5'''' and one second element 11'''' that are formed by cutting a helical channel in the layers that are applied on the surface by vacuum evaporization. The channel is provided with opposite enlarged parts that define elongated arcuate first and second elements. The elements are indicated in FIG. 5*c* by dotted lines. The enlarged part at the first element 5'''' is more extended than the enlarged part at the second element 11'''' so that the first element is narrower than the second element and, therefore, is more responsive to a heating current that the second element. In this case the pyrotechnical delay composition 6'''' has the shape of a solid semicylinder, which is pressed the surface 4'''' and the first element 5''''. The initiating composition layer 13'''' is pressed partly against the delay composition 6'''' and partly against the second element 11'''' the surface 4''''. The delay composition is comparatively short, as is the whole cap. The first and second elements are connected in series along a circle. One end of the two elements is connected to the unit 1'''' and the other end is connected to the unit 2''''. In FIG. 5*b* the current flow is indicated with arrows. The power level that is applied connected to units 1'''' and 2'''' determines whether the first or second element will be ignited and hence, whether the composition 13'''' will be ignited directly or via the delay composition. Instead of two elements with one delay composition and two power levels, it is possible to utilize three different elements (in series) with two delay compositions and three power levels for providing three delay times. Additional elements, delay compositions and power levels may be utilized to provide additional delay times.

The invention is not limited to the embodiments shown above, but is subject to modifications within the scope of the following claims. Thus, it is possible, for instance, to provide an electric igniter having three or more different ignition times, by connecting additional units to the units 1, 2 and 7, 8, as well as additional surfaces and elements. Also the external dimensions may be varied, for example the cap may be made with a diameter as small as approximately 3 mm and a length of approximately 4 mm.

I claim:

1. Electric ignition apparatus for igniting a pyrotechnical ignition charge at particular time delays corresponding to input triggering voltages, comprising:

electrically conducting container means for containing said ignition charge and for defining a closed, pressurized ignition area;

support means having an outer electrically conducting shell unit disposed within said container means and in electrical contact with said container means, said support means having an end support portion and an electrode unit positioned in an insulated, spaced relation to said shell unit within said container means, the electrode unit extending outside said container means to receive said input triggering voltages;

a first heating element means and a second heating element means connected in series and supported on the end support portion of said support means, the first heating element means electrically connected to said electrode unit and the second heating element means electrically connected to said outer conducting shell, said first heating element means dimensioned to heat to an ignition temperature in response to at least a first level of applied input triggering voltage and said second heating element means disposed adjacent at least a portion of said ignition charge and dimensioned to heat to an ignition temperature to ignite the ignition charge in response to at least a second higher level of applied input triggering voltage, and at least one pyrotechnical delay means positioned adjacent said first heating element means at one end and adjacent at least a portion of said ignition charge at another end, said delay means burning at a particular rate after being ignited by said first heating element and igniting said ignition charge after a time delay defined by the dimensions of said delay means.

2. The apparatus of claim 1 wherein said shell unit is cylindrical in shape and said electrode unit is a metal shaft embedded in insulating material disposed within the cylindrical shell unit, and the end support portion is a metal end cap on said cylindrical shell unit, the metal of the end cap contacting an end of said metal shaft and said shell unit and having a spiral channel defining a first arcuate metal area as said first heating element and a second larger arguate metal area as said second heating element.

3. The apparatus of claim 1 wherein said ignition charge includes a bottom layer of silver or lead azide adjacent said delay means and said end support portion and a top layer of hexogen or penthrite.

* * * * *